US008657154B2

(12) United States Patent
Obitts et al.

(10) Patent No.: US 8,657,154 B2
(45) Date of Patent: Feb. 25, 2014

(54) LOSS PREVENTION MERCHANDISER

(75) Inventors: Shane Obitts, Elyria, OH (US); Gregory M. Bird, Solon, OH (US); Gerald Szpak, North Royalton, OH (US)

(73) Assignee: Fasteners For Retail, Inc., Twinsburg, OH (US)

( * ) Notice: Subject to any disclaimer, the term of this patent is extended or adjusted under 35 U.S.C. 154(b) by 223 days.

(21) Appl. No.: 13/233,558

(22) Filed: Sep. 15, 2011

(65) Prior Publication Data

US 2012/0067917 A1 Mar. 22, 2012

Related U.S. Application Data

(60) Provisional application No. 61/383,859, filed on Sep. 17, 2010.

(51) Int. Cl.
*G07F 11/06* (2006.01)

(52) U.S. Cl.
USPC ..... 221/124; 211/59.2; 211/59.3

(58) Field of Classification Search
USPC ..... 221/123, 124; 211/59.2, 59.3
See application file for complete search history.

(56) References Cited

U.S. PATENT DOCUMENTS

| | | | | |
|---|---|---|---|---|
| 4,887,737 | A | 12/1989 | Adenau | |
| 7,150,365 | B2 | 12/2006 | Hardy et al. | |
| 7,299,934 | B2 | 11/2007 | Hardy et al. | |
| 7,389,886 | B2 | 6/2008 | Hardy et al. | |
| 7,451,881 | B2 | 11/2008 | Hardy et al. | |
| 7,497,341 | B2 | 3/2009 | Hardy et al. | |
| 7,559,437 | B2 | 7/2009 | Colelli et al. | |
| 7,621,409 | B2 | 11/2009 | Hardy et al. | |
| 7,641,072 | B1 | 1/2010 | Vlastakis et al. | |
| 7,661,545 | B2 | 2/2010 | Hardy et al. | |
| 7,669,722 | B2 | 3/2010 | Hardy et al. | |
| 7,828,158 | B2 * | 11/2010 | Colelli et al. | 211/59.3 |
| 7,980,417 | B2 | 7/2011 | Riley | |
| 8,190,289 | B2 * | 5/2012 | Lockwood et al. | 700/236 |
| 8,240,486 | B2 * | 8/2012 | Niederhuefner et al. | 211/51 |
| 2004/0060944 | A1 | 4/2004 | Gervasi | |
| 2005/0189369 | A1 | 9/2005 | Vlastakis et al. | |
| 2006/0266762 | A1 | 11/2006 | Andrews et al. | |
| 2008/0245811 | A1 | 10/2008 | Colelli et al. | |
| 2008/0283477 | A1 | 11/2008 | Wamsley et al. | |
| 2008/0314847 | A1 * | 12/2008 | Colelli | 211/59.3 |
| 2009/0184130 | A1 | 7/2009 | Miller et al. | |
| 2009/0321373 | A1 | 12/2009 | Hardy | |
| 2010/0237093 | A1 | 9/2010 | Lockwood et al. | |
| 2011/0220597 | A1 | 9/2011 | Sherretts et al. | |
| 2011/0284571 | A1 | 11/2011 | Lockwood et al. | |

FOREIGN PATENT DOCUMENTS

| | | | |
|---|---|---|---|
| EP | 0979628 | A1 | 8/1999 |
| GB | 2 386 116 | | 9/2003 |
| WO | WO 2011/094805 | A1 | 8/2011 |

OTHER PUBLICATIONS

FFR-DSI Yellow Pages 2010 Product Catalog, cover page, pp. 234-240, 327-334.

* cited by examiner

*Primary Examiner* — Patrick Mackey
(74) *Attorney, Agent, or Firm* — Fay Sharpe LLP

(57) ABSTRACT

A merchandise dispensing apparatus for providing theft deterrence includes a housing defining an interior space adapted to hold a plurality of associated products. A vending door is mounted to the housing for selectively allowing access to the interior space. A bar is provided on which the associated products are supported, the bar extending in the interior space of the housing. An advancing assembly is disposed in the housing for urging product supported on the bar in a direction towards the vending door.

22 Claims, 11 Drawing Sheets

LOSS PREVENTION MERCHANDISER

BACKGROUND

This application claims priority from U.S. Provisional Application Ser. No. 61/383,859 which was filed on Sep. 17, 2010. The subject matter of that application is incorporated hereinto by reference in its entirety.

The present disclosure pertains to merchandise dispensing devices for retail venues where theft of merchandise which is displayed on open shelves is a concern. More particularly, the present disclosure relates to a dispensing device which allows single products to be accessed but prevents multiple products from being removed from the dispensing device at the same time.

Recently, retail stores which traditionally display products on open shelves have experienced product theft. Items which are in high demand by thieves include cough and cold medications, razor blades, camera, film, batteries, DVDs, smoking and smoking cessation articles, fragrances, infant formula and the like. Shelf sweeping is a particular problem for small items. Such "sweeping" occurs when one or more people remove all or most of the items displayed on a shelf into a bag or the like and exit the store. Shelf sweeping relies on the ability to remove multiple items from the shelf at one time. In order to deter such sweeping, a merchant or retailer could only display a single item on the shelf. However, then the merchant must constantly restock the shelf, which would be very difficult to do. Therefore, merchants keep substantial inventory on a shelf, making such inventory susceptible of theft.

Retailers are constantly challenged to balance the needs of legitimate consumer's access to high theft items with measures to minimize the incidence of theft. Because theft has become so rampant in connection with certain product categories such as razors and infant formula, many retail stores are taking such products off the shelf and placing them behind a counter or under lock and key. If this is done, customers must request the products in order to make a purchase. However, such measures are disadvantageous as they add additional labor costs in order to provide individual service to customers who would not normally require it. Also, such a merchandising technique makes it difficult for customers to compare products side by side. Moreover, it may be difficult to store multiple such products behind a counter, as counter space is limited and may be needed for other items, such as prescription medications, expensive fragrances or the like.

Product dispensing devices which deter theft, such as vending machines, are well known. They have been used for storing products of all sorts and for vending such products to consumers in exchange for money, generally coins and/or currency without vendor attention. However, the known vending machines are expensive to manufacture and operate and are not readily adapted for use in vending numerous types of products in a retail environment such as a drug store or a grocery store.

Also known is a theft deterring merchandise dispenser which utilizes a helical coil to hold and dispense product between coil windings. Merchandise packages are slidingly mounted on a rod. The rotation of a knob rotates the helical coil and causes the merchandise packages to slide along the rod. However, this known design requires an individual housing for each rod and helical coil combination with the housing being adapted for mounting on a peg board display.

Further known is a merchandise dispensing apparatus providing theft deterrence that includes a box structure defined by a plurality of walls and a door allowing access to an interior space defined within the box structure. A plurality of pushers and dividers are employed to separate the merchandise held in the box structure into a group of columns. A rotatable knob is employed to select a piece of merchandise, separate it from the column and move it towards the door so that it can be accessed by a consumer. This design requires dividers to separate the columns of products from each other.

Accordingly, it has been considered desirable to develop an improved loss prevention merchandiser which would overcome the foregoing difficulties and others while meeting at least some of the above stated needs and providing better and more advantageous overall results.

BRIEF SUMMARY OF THE DISCLOSURE

A merchandise dispensing apparatus according to the present disclosure provides theft deterrence. More particularly, the merchandise dispensing apparatus comprises a housing defining an interior space adapted to hold a plurality of associated products. A vending door is mounted to the housing for selectively allowing access to the interior space. A bar is provided on which the associated products are supported, the bar extending in the interior space of the housing. An advancing assembly is disposed in the housing for moving the associated product supported on the bar in a direction towards the vending door.

According to another embodiment of the present disclosure, a merchandise dispensing apparatus comprises a housing including a top wall and a pair of side walls defining an interior space adapted to store associated merchandise. The housing comprises a front end. A vending door is mounted to the front end of the housing for selectively allowing access to the interior space. A bar is provided on which the associated merchandise is supported in a columnar form. The bar extends in the interior space of the housing towards the front end thereof. A spring urged pusher assembly is disposed in the housing for urging the associated merchandise in a direction towards the vending door.

Other features and advantages of the present disclosure will become apparent from the following more detailed description, taken in conjunction with the accompanying drawings which illustrate by way of example several embodiments of the presently described apparatus and its method of use.

BRIEF DESCRIPTION OF THE DRAWINGS

The disclosure may take form in certain structures and components, several embodiments of which will be described in detail in this specification and illustrated in the accompanying drawings.

DETAILED DESCRIPTION

Figure 1:
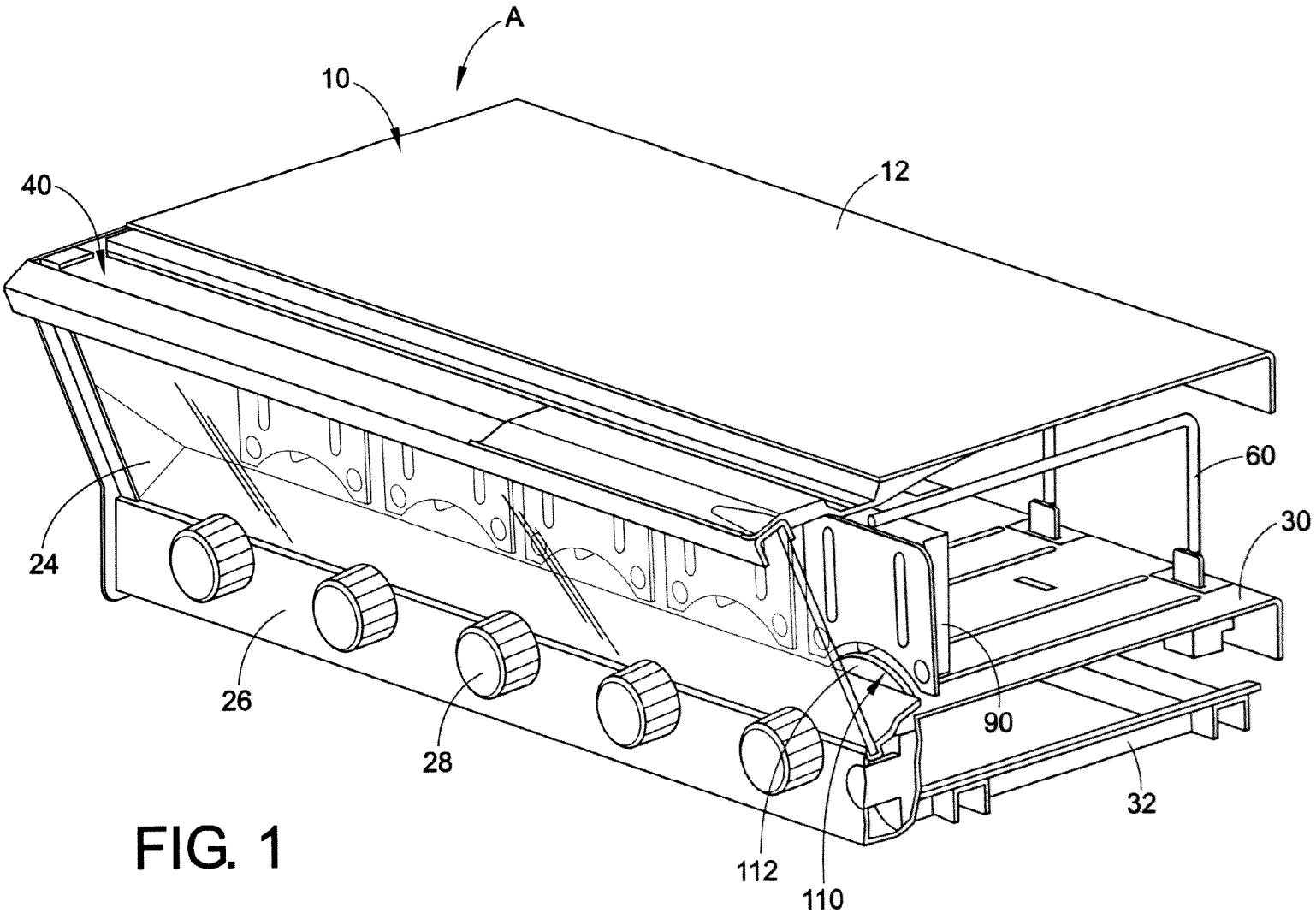
FIG. 1 is a schematic perspective view, partially cut away, of a merchandise dispensing apparatus according to a first embodiment of the present disclosure.
Figure 2:
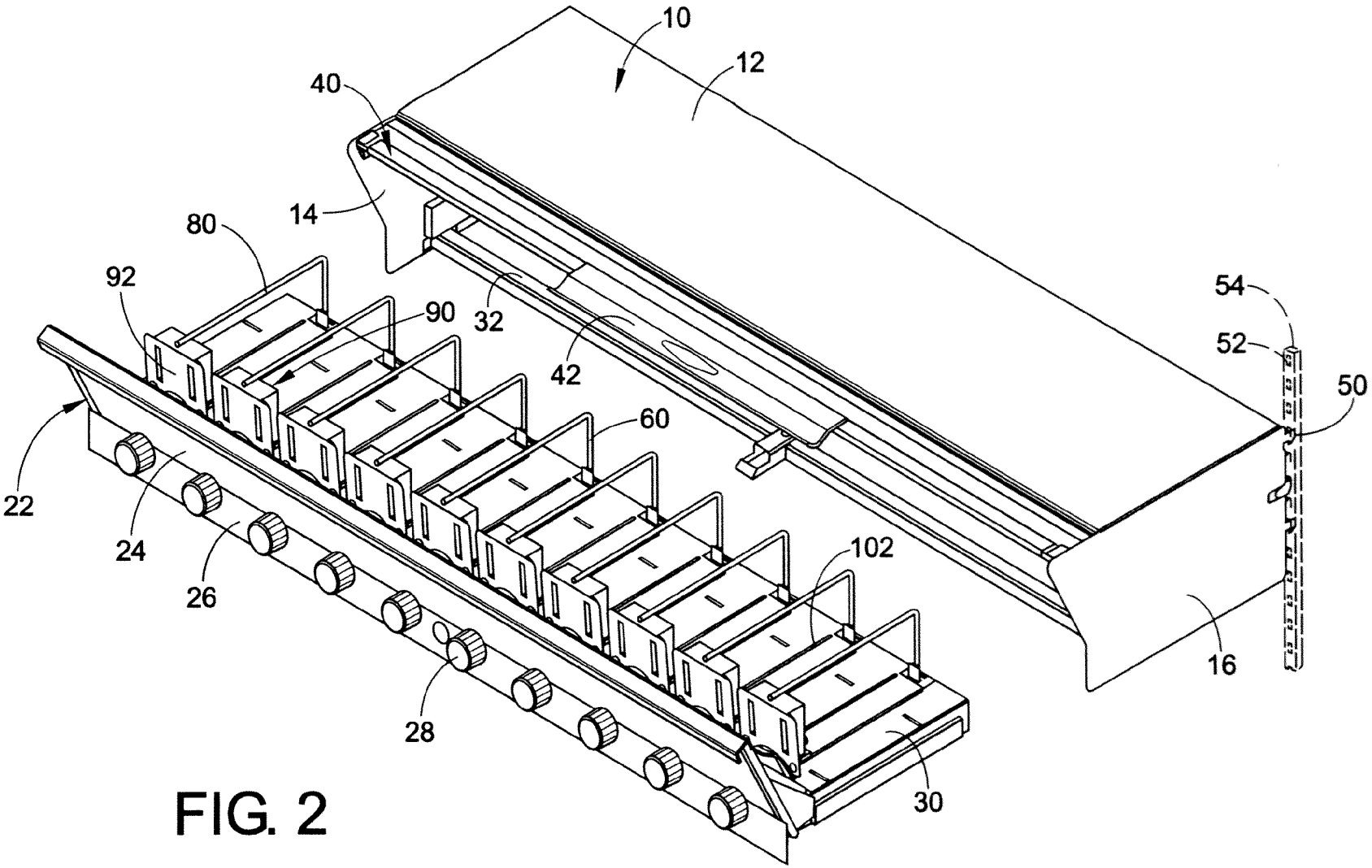
FIG. 2 is an exploded perspective view of he merchandise dispensing apparatus of FIG. 1.
Figure 3A:
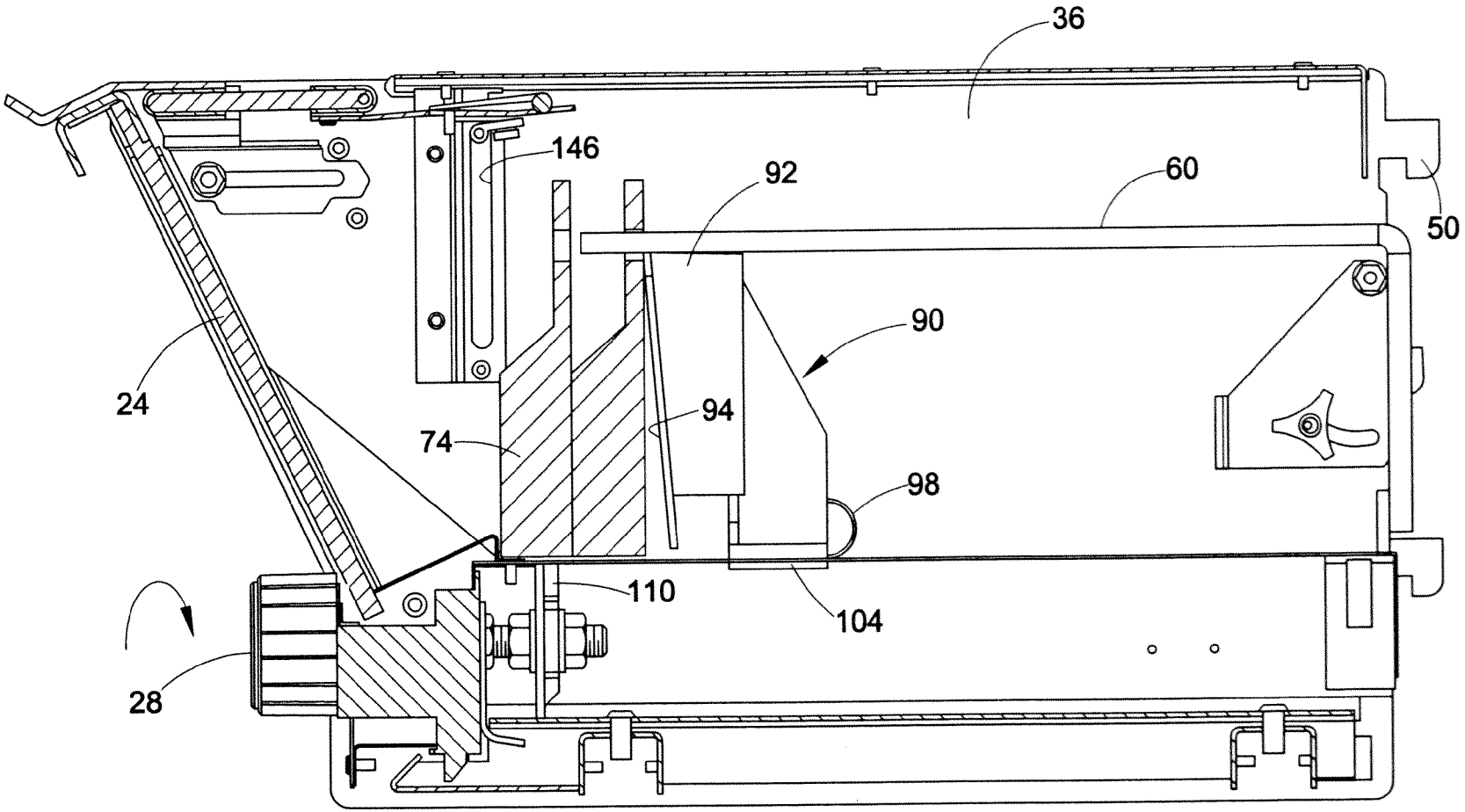
FIG. 3A is an enlarged side elevational view in cross section of the merchandise dispensing apparatus of FIG. 1 in a first position.

Referring now to the drawings, wherein the showings illustrate several embodiments of the disclosure only and are not intended to limit same, FIG. 1 shows a merchandise display and dispensing apparatus A including a housing 10 which comprises a top wall 12. With reference now also to FIG. 2, the housing further includes first and second side walls 14 and 16, as well as a front wall 22. The front wall includes a transparent window section 24, as well as a bottom section 26 to which are mounted a plurality of spaced knobs 28. The housing further comprises a bottom wall 30 which can be part of a slide out tray that is mounted on a frame 32. With reference now also to FIG. 3A, the housing 10 defines an interior space 36.

Held or stored in the interior space 36 is merchandise that is meant to be vended by the display and dispensing apparatus A. For example, such merchandise can be a high value/high theft item. One example of such an item is razor blades, as noted previously.

Figure 3B:
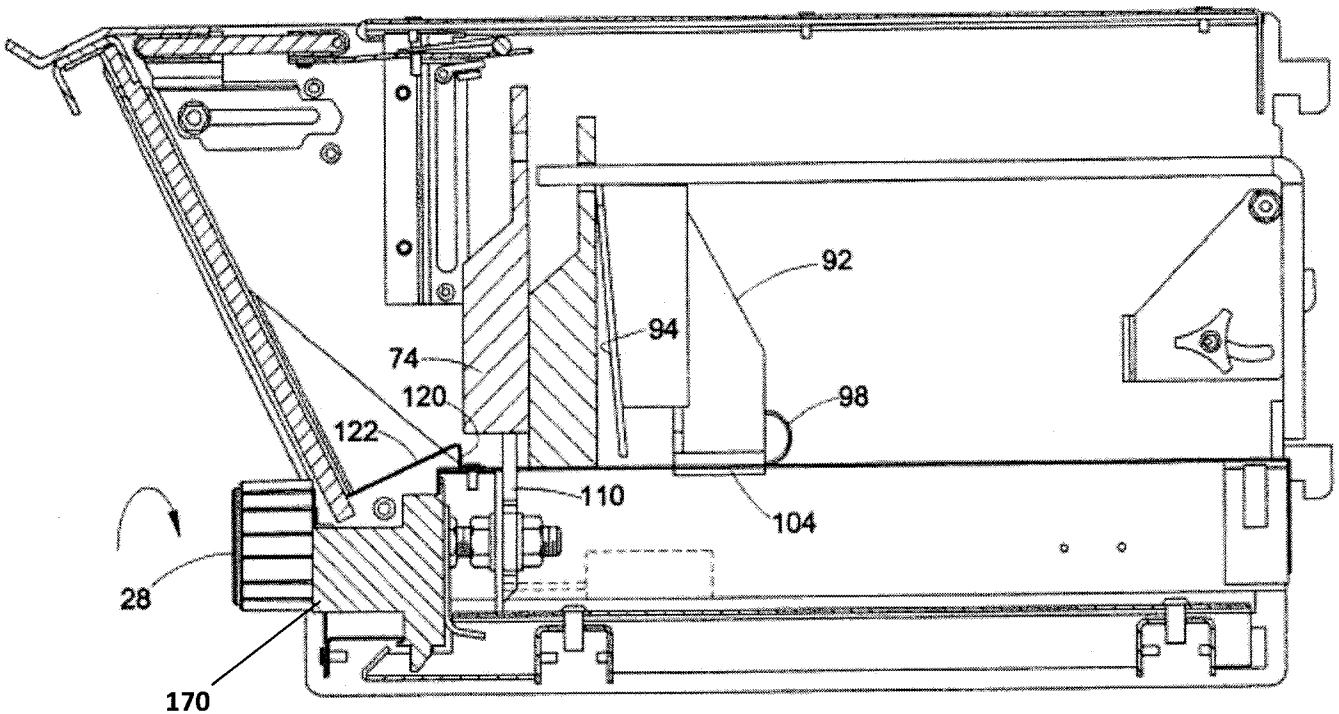
FIG. 3B is a side elevational view in cross section of the apparatus of FIG. 3A in a second position.
Figure 3C:
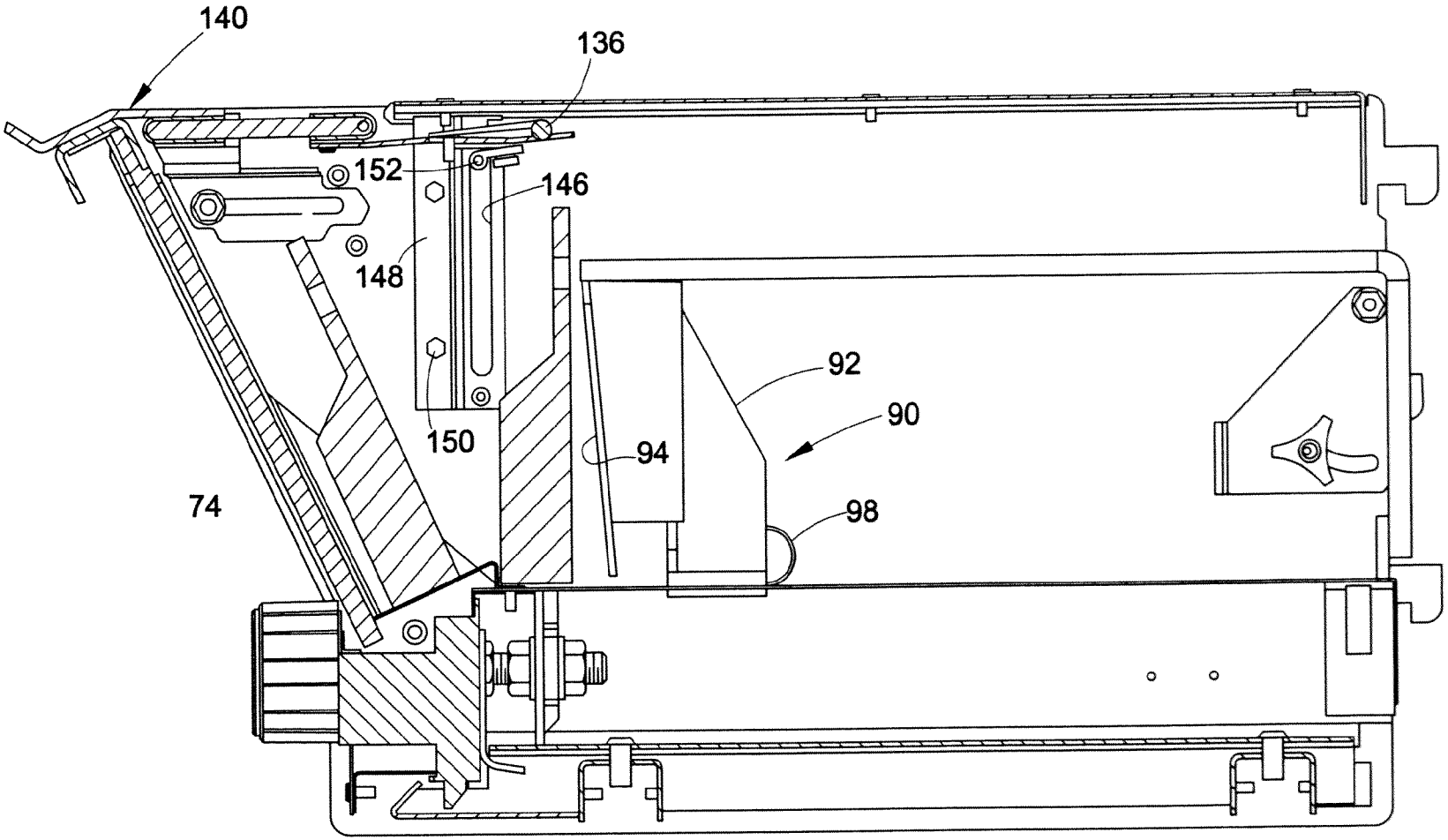
FIG. 3C is a side elevational view in cross section of the apparatus of FIG. 3A in a third position.

Disposed between the top wall 12 and the front wall 22 is a door 40 through which articles can be retrieved from the housing. Thus, it serves as a vending door. With reference now to FIG. 3E, the vending door 40 includes a handle 42, a window section 44 and a pivot 46. It can be appreciated that in the disclosed embodiment, a potential customer can view the product being vended through the transparent window section 24 in the front wall, as well as being able to view the top of the product through the window section 44 in the vending door 40, once the product has been advanced to the front wall 22. As may be appreciated, the door can be pivotally mounted to the two side walls 14 and 16 and, in one embodiment, can extend across the entire width of the housing 10. In other embodiments, individual doors could be provided, one for each column of product held in the housing.

With reference again to FIG. 2, the housing 10 can be mounted via teeth 50 in apertures 52 defined in uprights or standards 54 as are commonly found in a merchandising environment. Once the housing 10 has been mounted to the standards, access to merchandise held in the housing 10 is only provided via the vending door 40. As is evident from FIG. 3A, a rear wall for the housing 10 is not necessary when the housing is mounted on the uprights or standards 54 as access to the merchandise held in the housing is no longer possible from the rear, presuming that the standards are mounted to a barrier or wall.

Figure 4:
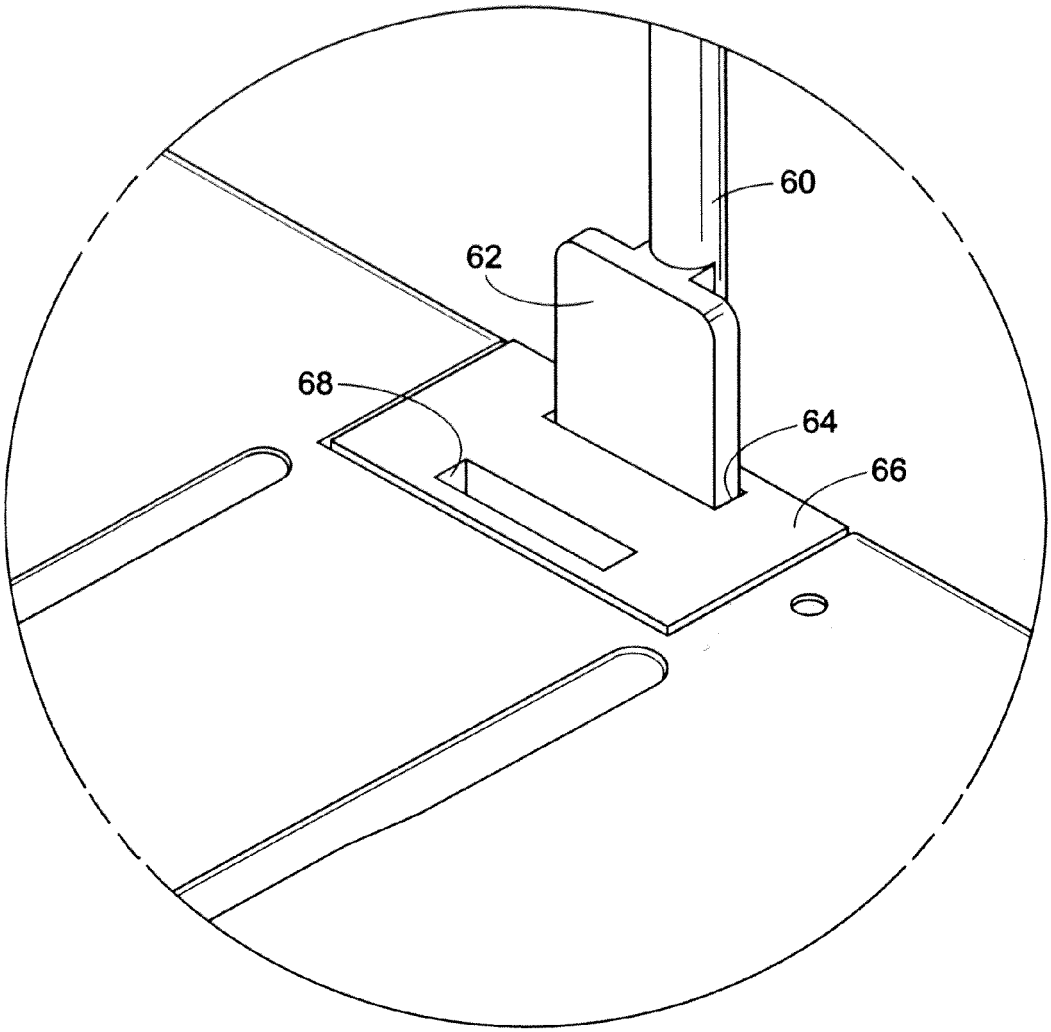
FIG. 4 is an enlarged perspective view of a portion of the apparatus of FIG. 2.

In this embodiment, the merchandise held in the interior space 36 of the housing 10 is mounted on or supported by elongated bars, hooks or hangers 60. With reference now to FIG. 4, each elongated bar 60 is mounted to a support or base 62. In the embodiment illustrated, the hangers 60 include a generally horizontally oriented portion which is connected to a generally vertically oriented portion. The bottom end of the vertically oriented portion is connected to the base or support 62. It should be appreciated that other designs for the elongated bars could also be employed. The support is so shaped that it can selectively fit in a first socket 64 of a support base or housing 66.

Figure 5:
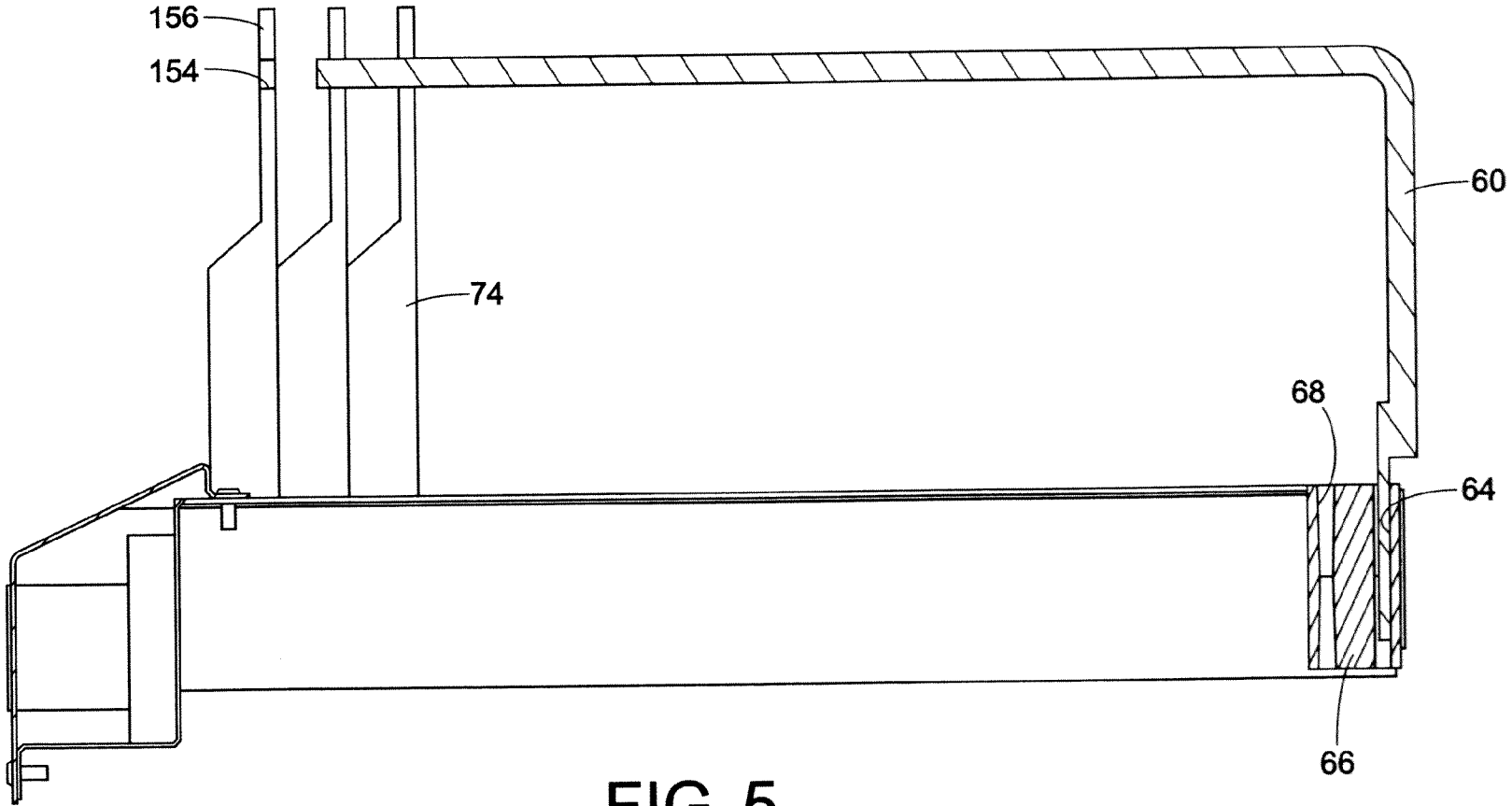
FIG. 5 is a schematic side elevational view of a portion of the merchandise dispensing apparatus of FIG. 1 when used to display relatively thick packages of products in a column; and, FIG. 6 is a side elevational view in cross section of a portion of the merchandise dispensing apparatus of FIG. 1 when used to display relatively thin packages of products in a column.
Figure 6:
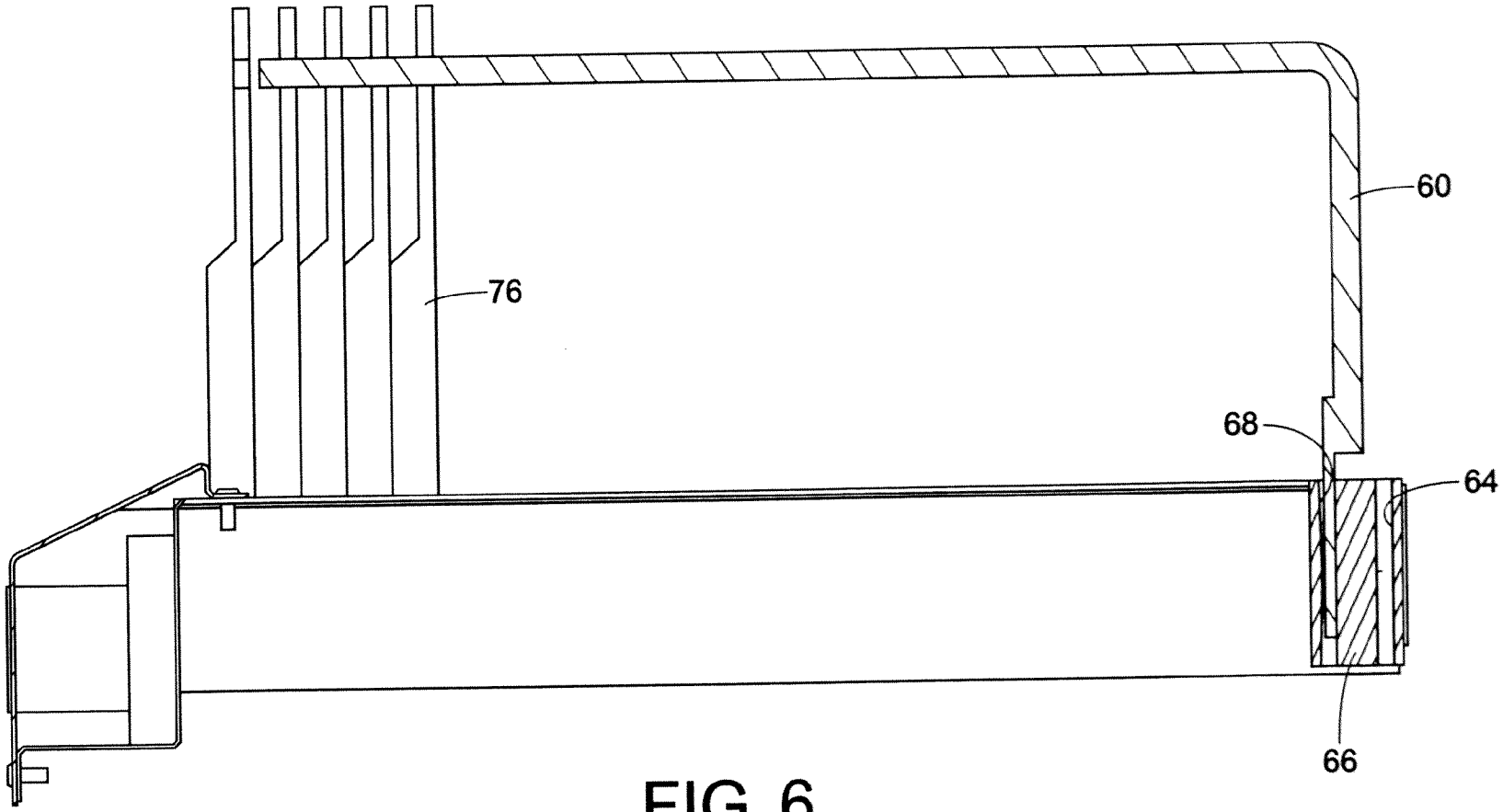

The housing is also provided with a spaced second socket 68. The reason for providing two spaced sockets, which can also be seen in FIGS. 5 and 6, is to allow merchandise of varying thicknesses to be successfully vended by the merchandise display and dispensing apparatus A. More particularly, a column of relatively thicker packages 74 is displayed in FIG. 5, whereas a column of relatively thinner packages 76 is displayed in FIG. 6. For the thicker packages, the support base 62 is mounted in the first socket 64, whereas for the thinner packages, the support base 62 is mounted in the second socket 68. It should be appreciated that other geometries are also conceivable.

As is evident from FIGS. 1 and 2, a plurality of generally aligned columns of product 80 can be vended by the apparatus A. The merchandise suspended in each column of product can be advanced forwardly towards the vending door 40 by a respective advancing assembly 90. In one embodiment, such advancing assemblies can each include a pusher 92. With reference now to FIG. 3C, the pusher 92 includes a pusher face 94 and a biasing member 98 which can be in the form of a coil spring. In the embodiment illustrated in FIG. 3C, it can be seen that the pusher face 94 is canted somewhat in relation to a vertical axis. In this way, a top portion of the pusher face is located closer to a back side of the package 74 than is a bottom portion thereof. This orientation of the pusher face has the benefit of making it more likely that the portion of the package adjacent the suspension point of the package on the hook will be urged forward. In other words, the package won't be hung up by friction on the hook or canted in such a way as to be more likely to be hung up on the hook at its point of suspension. It is also evident from FIG. 3C that the package, when hung from the hook, clears the bottom wall 30 of the housing so as to reduce friction between the package and the housing bottom wall as the package is moved forward on the hook by the pusher 92.

The pusher 92 of the advancing assembly 90 can ride in a track 102 which in the embodiment illustrated is defined in the bottom wall 30 of the housing, as is best shown in FIG. 2. To this end, the pusher 92 can be provided with a base portion 104 as is best shown in FIG. 3B. Of course, a plethora of other pusher track designs are known and could be employed.

With reference now to FIGS. 3A to 3E, a method or process for vending an item from one of the columns of product held in the merchandise display and dispensing apparatus A is there illustrated. Referring now to FIG. 3A, let us suppose that a customer decides to purchase a package 74 displayed at the front of a column of merchandise supported on the elongated bar 60 and visible through window 24 at the front of the column. It should be evident that the front package 74 clears the rod 60. In other words, the front package is no longer supported on the rod. With reference now to FIG. 3B, the customer rotates knob 28. This causes a raising plate 110 having a camming surface 112 (see FIG. 1) to rotate on shaft 116 that is mounted to knob 28. The camming surface raises the front package 74 above a shoulder 120 disposed on a support surface 122 that is mounted at the front end of the bottom wall 30. With reference now to FIG. 3C, the chosen package 74 falls forward, is supported on the support surface 122, and slides forward since the support surface is angled. Eventually, the product comes to rest against the backside of the front wall 22. Then, the customer accesses the vending door 40.

Figure 3D:
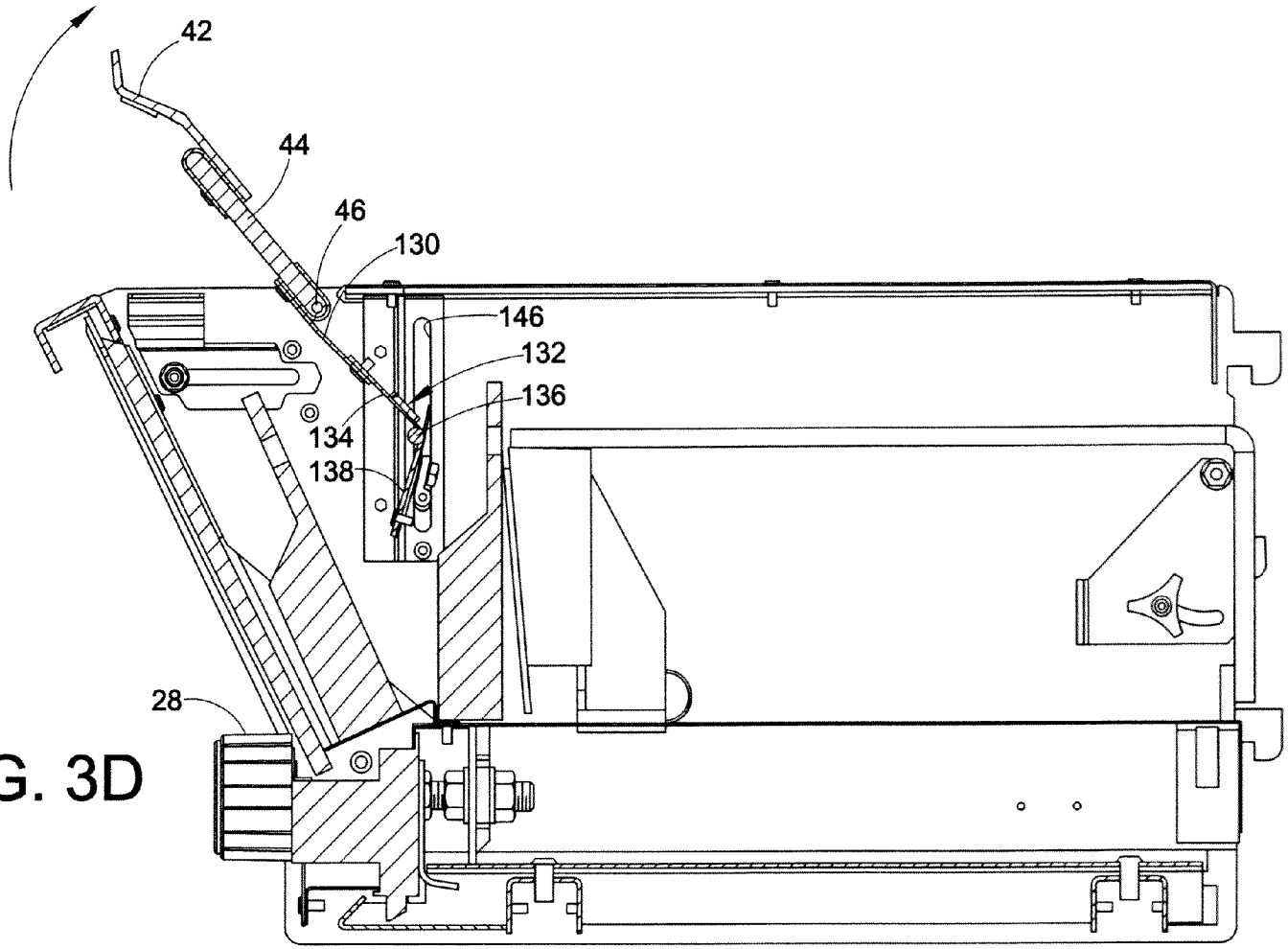
FIG. 3D is a side elevational view in cross section of the merchandise apparatus of FIG. 3A in a fourth position.
Figure 3E:
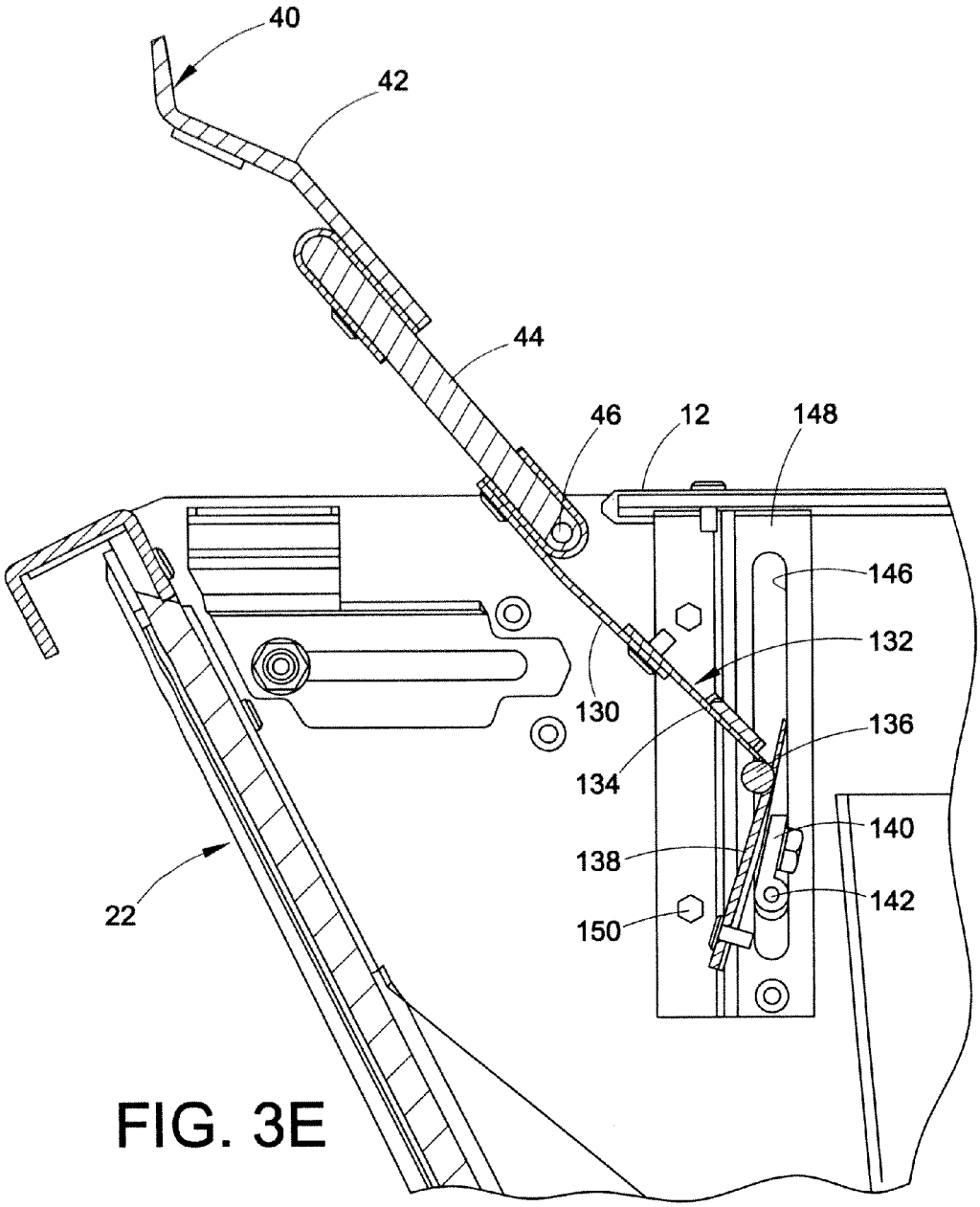
FIG. 3E is an enlarged side elevational view in cross section of a portion of the apparatus of FIG. 3D.

With reference now to FIG. 3D, the customer pulls up on the handle 42 of the door 40 thereby also raising window section 44 of the door, as it rotates on pivot 46. With reference now also to FIG. 3E, in this embodiment, the door 40 is connected to a link 130 which activates a barrier assembly 132. In this embodiment, the barrier assembly includes a first leg 134 which is connected to the link 130, a hinge 136 and a second leg, which can also be termed a barrier strip 138. Mounted to the barrier strip 138 is a carriage or support 140. Extending from the carriage 140 is a pin, bolt, screw or similar elongated member. The pin 142 rides in a slot 146 of a track 148 that can be fastened to at least one of the side walls 14 and 16 of the housing 10 via suitable fasteners 150. In this way, when the vending door 40 is opened, the barrier strip 138 descends and blocks further access to product within the interior space of the housing. In other words, access is only had to the one item of merchandise 74 which lies in front of the barrier strip, as is illustrated in FIG. 3D. It should be appreciated that other embodiments of such a barrier assembly are also contemplated. Moreover, in certain merchandising settings, perhaps a barrier assembly is not even necessary.

In one embodiment, an alert device 170 (FIG. 3B) is provided for the merchandise dispensing apparatus. For example, the alert device could be connected to the knob 28 via one or more known electrical or mechanical connections 172. Thus, as the customer rotates the knob 28 the alert device is triggered. In one embodiment, the alert device could be a sound making device so that rotation of the knob will emit a sound emanating from the housing 10. In another embodiment (not shown), the alert device can be connected to the door 40 so that when the customer pulls on the handle 42 of the door, the alert device is triggered. It should be appreciated that the alert device does not necessarily have to be a sound making device. It could instead be a light or an electronic signal which is sent to store security or other store personnel such as at checkout. In this way, when high value items are vended from the housing 10 store personnel are notified.

The merchandise is arranged in and kept in columns by being hung from or suspended on the elongated bars, hangers or supports 60, one package being located behind the other. To this end, it should be appreciated that each piece of merchandise is provided with a suitable aperture 154 disposed in a tab 156 of the product package that is illustrated in FIG. 5. Also, two products will be unlikely to be vended at the same time because the elongated bar or hook or hanger can be adjusted for the thickness of the product being vended, as discussed above.

Figure 3F:
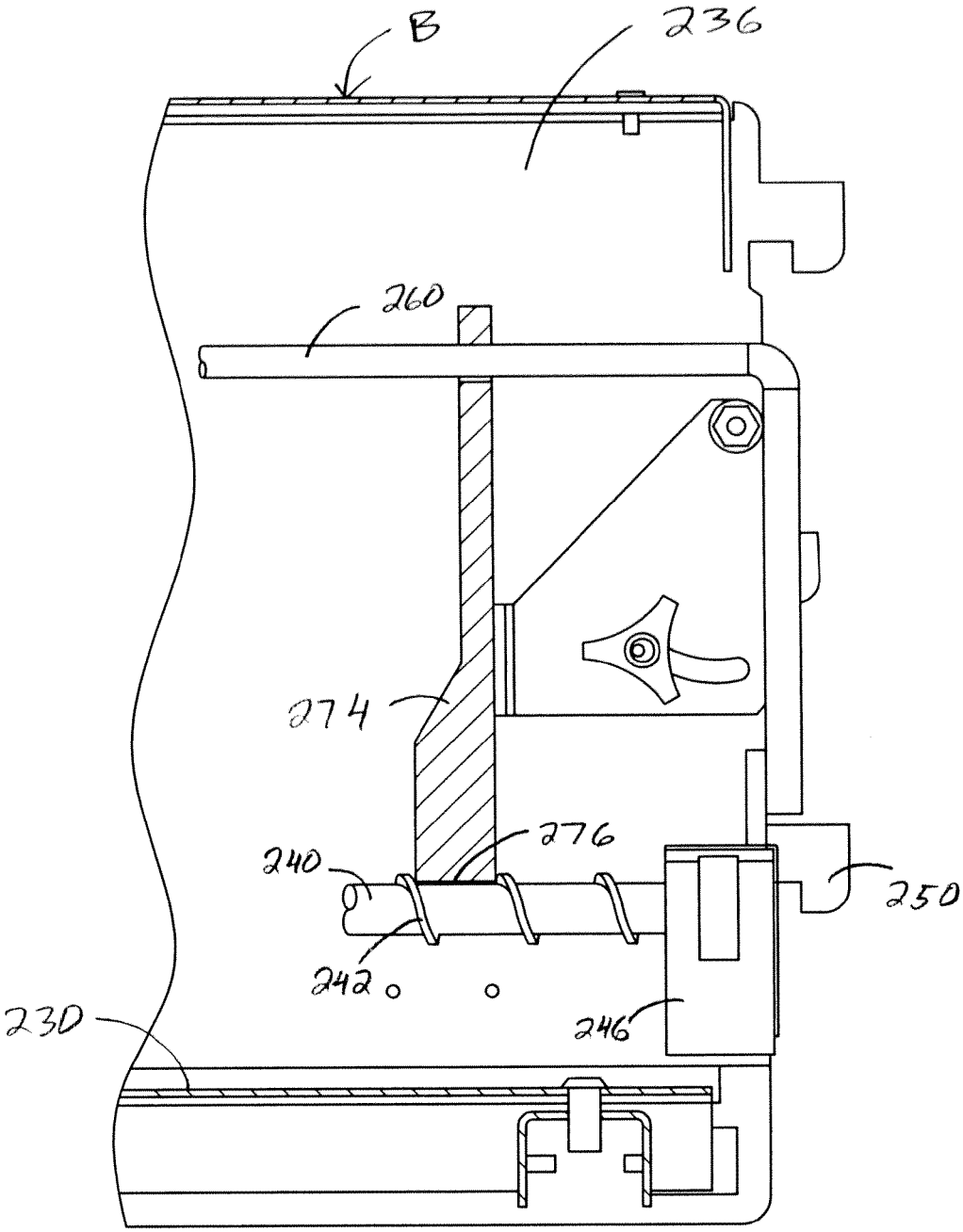
FIG. 3F is a fragmentary side elevational view of a portion of a dispensing apparatus according to another embodiment of the present disclosure.

With reference now to FIG. 3F, an alternate embodiment of a loss prevention merchandiser is there illustrated. In this embodiment, a dispensing apparatus B comprises a bottom wall 230 which helps define an interior space 236. Extending in the interior space is a shaft or rod 240. The shaft is provided with a helically extending fin or thread 242 which protrudes from the outer periphery of the shaft. The thread 242 can be a coarse Acme thread. The back end of the shaft is rotatably mounted in a housing 246. The front end thereof is connected to a knob, such as the knob 28 illustrated in FIG. 3A. The apparatus B can be mounted to a vertical support by teeth 250 as is known in the art. Also extending in the interior space 236 is a hanger or support bar 260. Mounted thereon is a package 274. In this embodiment, a bottom end 276 of the package approaches the shaft 240 such that the bottom end is located between two adjacent portions of the fin or thread 242. Rotation of the knob in one direction causes the package to advance along the hanger bar 260 towards a door of the dispensing apparatus B. Thus, what has been disclosed in FIG. 3F is another form of an advancing assembly disposed in the housing for moving the product 274 supported on the bar 260 in a direction towards the vending door. Also, it should be recognized that the knob could be rotated in a reverse direction such that the shaft rotates backwards, thereby pushing products backwards in the interior space 236.

It is acknowledged that certain products do not have a package construction which provides a tab with an aperture. For such products, it would normally not be feasible to mount them in a columnar arrangement and suspended from a hook, such as the hook 60 illustrated in FIG. 2. However, for such products, known adhesive tabs, which include an aperture, can be employed so that the tabbed product can be suspended from a peg hook or the like, such as in a peg board display. Similarly, for the instant merchandising apparatus, such adhesive tabs can be applied to the packages of the product and the package can then be suspended from the bars, hangers or hooks illustrated herein.

It should be noted that the merchandise dispensing and display apparatus illustrated herein avoids the need for employing divider walls between each two columns of merchandise. Such divider walls are used in an effort to prevent the merchandise from sliding sideways and out of the column in which it was originally positioned. Providing hangers or supports on which the merchandise can be hung keeps the merchandise packages in columnar form and eliminates the need for such divider walls.

The merchandise dispensing apparatus disclosed herein minimizes the incidence of product theft, but allows purchasers access to products without requiring store personnel intervention and is less expensive than the known vending machines. The merchandising apparatus disclosed is able to fit within common grocery, drug store or other retail environment shelves and effectively displays the products or items for purchase so consumers can easily identify them. Further, the disclosed merchandising apparatus has an adjustment feature which accommodates merchandise of various thicknesses. Also, the disclosed merchandise dispensing system is easy to use. An interlock has also been disclosed for blocking access to stored merchandise when a dispensed item is made accessible to a consumer. The merchandising assembly can be easily restocked when necessary, but can be locked in a use position in order to prevent access by unauthorized personnel to the restock position in which all of the merchandise can be accessed at one time.

The dispensing apparatus disclosed herein could be integrated with an inventory control system (not shown) to monitor the quantity, location and status of product contained in each column of items held in the dispensing apparatus A.

It should be appreciated that the various items and components disclosed herein can be made from any suitable conventional materials which include various types of metals, thermoplastics, reinforced resin materials and combinations thereof.

While the disclosure herein has been to a merchandise dispensing apparatus, wherein the merchandise or articles being sold are advanced by an advancing assembly on a generally horizontally oriented elongated bar on which the products are supported, it should be apparent that the merchandising dispensing apparatus disclosed herein could also be used in a gravity fed system. In other words, rather than having an advancing assembly urging product forward along a generally horizontally oriented elongated bar, the bar could be canted downwardly so that gravity feeds the product forward on the bar. In this embodiment, a spring biased pusher would no longer be necessary. It could be replaced with a gravity biased pusher. Alternatively, a system in which no pusher of any sort is employed can be envisaged if the packages can simply slide down the elongated bar by the force of gravity.

The exemplary embodiments of the present disclosure have been described with reference to the above detailed description. Obviously, modifications and alterations will occur to others upon a reading and understanding of the preceding detailed description. It is intended that the disclosure not be limited to the embodiments described. Rather, the present disclosure should be construed as including all such modifications and alterations as come within the scope of the appended claims or the equivalents thereof.

The invention claimed is:

1. A merchandise dispensing apparatus providing theft deterrence, comprising:

a housing defining an interior space adapted to store a plurality of associated products and including a bottom wall;

a vending door mounted to the housing for selectively allowing access to the interior space;

a bar from which products are suspended, the bar being mounted in the housing; and an advancing assembly disposed in the housing for moving the associated product supported from the elongated bar in a direction towards the vending door, wherein the advancing assembly is supported on the bottom wall and includes a pusher face and a biasing member operably connected thereto for urging the pusher face in a direction towards the vending door, wherein the pusher face is canted.

2. The apparatus of claim 1 wherein the vending door includes a transparent section.

3. The apparatus of claim 1 wherein the advancing assembly comprises a feed mechanism mounted to the housing for selectively moving the associated product in a direction towards the vending door.

4. The apparatus of claim 1 wherein the mechanism for urging includes a spring.

5. The apparatus of claim 1 wherein the housing includes a support surface and wherein a front face of the bar is located behind the support surface.

6. The apparatus of claim 1 further comprising a merchandise ejector.

7. The apparatus of claim 6 wherein the merchandise ejector comprises a rotatably mounted knob.

8. The apparatus of claim 7 wherein the knob is connected to an alert mechanism.

9. The apparatus of claim 1 wherein the vending door comprises a barrier strip.

10. The apparatus of claim 9 wherein the barrier strip is part of a barrier assembly.

11. The apparatus of claim 10 wherein the barrier assembly is slidably mounted to the housing.

12. The apparatus of claim 1 wherein the housing further comprises a top wall, a first side wall, and a second side wall.

13. The apparatus of claim 1 further comprising a slide out shelf mounted to the housing, the bar and the advancing assembly being supported on the slide out shelf.

14. The apparatus of claim 13 further comprising a lock for securing the shelf to the housing.

15. A merchandise dispensing apparatus comprising:

a housing including a top wall, a bottom wall and a pair of side walls defining an interior space adapted to store associated merchandise, the housing comprising a front end;

a vending door mounted to the front end of the housing for selectively allowing access to the interior space;

a bar from which the associated merchandise is suspended in a columnar form, the bar extending in the interior space of the housing towards the front end thereof; and a spring urged pusher assembly supported on the bottom wall of the housing for urging the associated merchandise in a direction towards the vending door, wherein the pusher assembly includes a canted pusher face.

16. The apparatus of claim 15 further comprising a barrier operably connected to a vending door, wherein the barrier allows access to only a first item of merchandise in the column when the door is opened.

17. The apparatus of claim 16 wherein the barrier is pivotally connected to the door.

18. The apparatus of claim 15 further comprising an alert mechanism operatively connected to the door so that a signal is produced when the door is opened.

19. The apparatus of claim 15 wherein the pusher assembly is located beneath the bar.

20. The apparatus of claim 15 further including a pusher track along which the pusher assembly moves, wherein the pusher track is axially aligned with the bar.

21. The apparatus of claim 1 wherein the pusher face is canted towards the bar.

22. The apparatus of claim 15 wherein the pusher face is canted towards the bar.

* * * * *